US006099258A

United States Patent [19]

Litvin et al.

[11] Patent Number: 6,099,258

[45] Date of Patent: Aug. 8, 2000

[54] HIGH VELOCITY FAN

[75] Inventors: Charles Litvin; Gary Beideman, both of West Chester, Pa.

[73] Assignee: Lasko Holdings, Inc., West Chester, Pa.

[21] Appl. No.: 09/169,807

[22] Filed: Oct. 9, 1998

[51] Int. Cl.[7] ..... F04D 29/70

[52] U.S. Cl. ..... 416/247 R; 415/121.2; 415/213.1; 415/214.1; 416/244 R

[58] Field of Search ..... 415/213.1, 214.1, 415/121.2, 200; 416/244 R, 247 R, 100

[56] References Cited

U.S. PATENT DOCUMENTS 4,456,431 6/1984 Crespin ..... 416/189
4,927,324 5/1990 Coup et al. ..... 415/121.2
5,002,462 3/1991 Janisse ..... 416/247 R
5,613,833 3/1997 Wolfe et al. ..... 416/246
5,795,133 8/1998 Hill et al. ..... 416/247 R

*Primary Examiner*—Edward K. Look
*Assistant Examiner*—Ninh Nguyen
*Attorney, Agent, or Firm*—Zachary T. Wobensmith, III

[57] ABSTRACT

A high velocity fan which includes a pre-assembled motor cover assembly, which contains a mounting plate, which is provided with locator studs to engage with a grill plate on a fan, and which motor mounting plate and grill plate are fastened together with a plurality of blind rivets.

5 Claims, 3 Drawing Sheets

HIGH VELOCITY FAN

BACKGROUND OF THE INVENTION

1. Field of the Invention

This invention relates to a high velocity fan of the type which has open front and rear grills, with a pre-assembled fan motor cover assembly fastened to the fan's rear grill.

2. Description of the Prior Art

High velocity fans are in widespread use, and are generally constructed with open front and rear grills with the motor fan assembly mounted to the rear grill. These fans are sold at low prices and there is considerable competition in the marketplace. In order to be competitive, the costs of constructing the fans must be kept as low as possible, which is difficult as the assembly of the fans, which is usually accomplished by unskilled labor, is labor intensive due to the number of components and the sequence of assembly. For example, in a typical fan in order to assemble the motor to the rear grill the following steps are required:

Plug motor leads into switch.

Plug cord set leads into switch.

Wire motor ground wire to cord set ground wire with wire nut.

Feed cord set and switch through rear grill and align motor mounting bolts with rear grill motor support.

Using (4) hex nuts, attach motor to rear grill.

Position switch inside motor cover.

Using a screw, attach the switch to the cover.

Position motor cover against rear grill so that mounting holes align.

Using (3) screws, attach motor cover to rear grill.

Using glue, attach name plate to motor cover.

Using glue, attach switch plate to motor cover.

Affix switch knob to switch stem.

Test fan operation.

The listed steps also require that the assembler work from both sides of the fan grill and in tight places.

The complexity of the steps leaves considerable room for error, and the resultant product may have an unfinished appearance and be subject to problems due to the structure of the product.

The assembly of the high velocity fan of the invention requires the assembler to place the pre-assembled fan motor cover assembly in a holding fixture, position the rear grill plate in line with locating studs from the fan motor cover assembly, and insert and activate three blind rivets.

SUMMARY OF THE INVENTION

A high velocity fan which is assembled from a pre-assembled fan motor cover assembly, which assembly is located and attached to the fan rear grill by a plurality of blind rivets.

The principal object of the invention is to provide a high velocity fan that is easy and economical to assemble.

A further object of the invention is to provide a high velocity fan that has the fan motor cover assembly assembled onto the fan rear grill in one operation and in one direction.

A further object of the invention is to provide a high velocity fan that is less subject to assembly errors and to defects in operation.

A further object of the invention is to provide a high velocity fan that provides a more highly finished appearance.

A further object of the invention is to provide a high velocity fan wherein the wiring is internal to the fan motor cover assembly.

A further object of the invention is to provide a high velocity fan wherein the fan motor cover assembly is pretested prior to assembly to the fan rear grill.

Other objects and advantageous features of the invention will be apparent from the description and claims.

DESCRIPTION OF THE DRAWINGS

The nature and characteristic features of the invention will be more readily understood from the following description taken in connection with the accompanying drawings in which.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Figure 1:
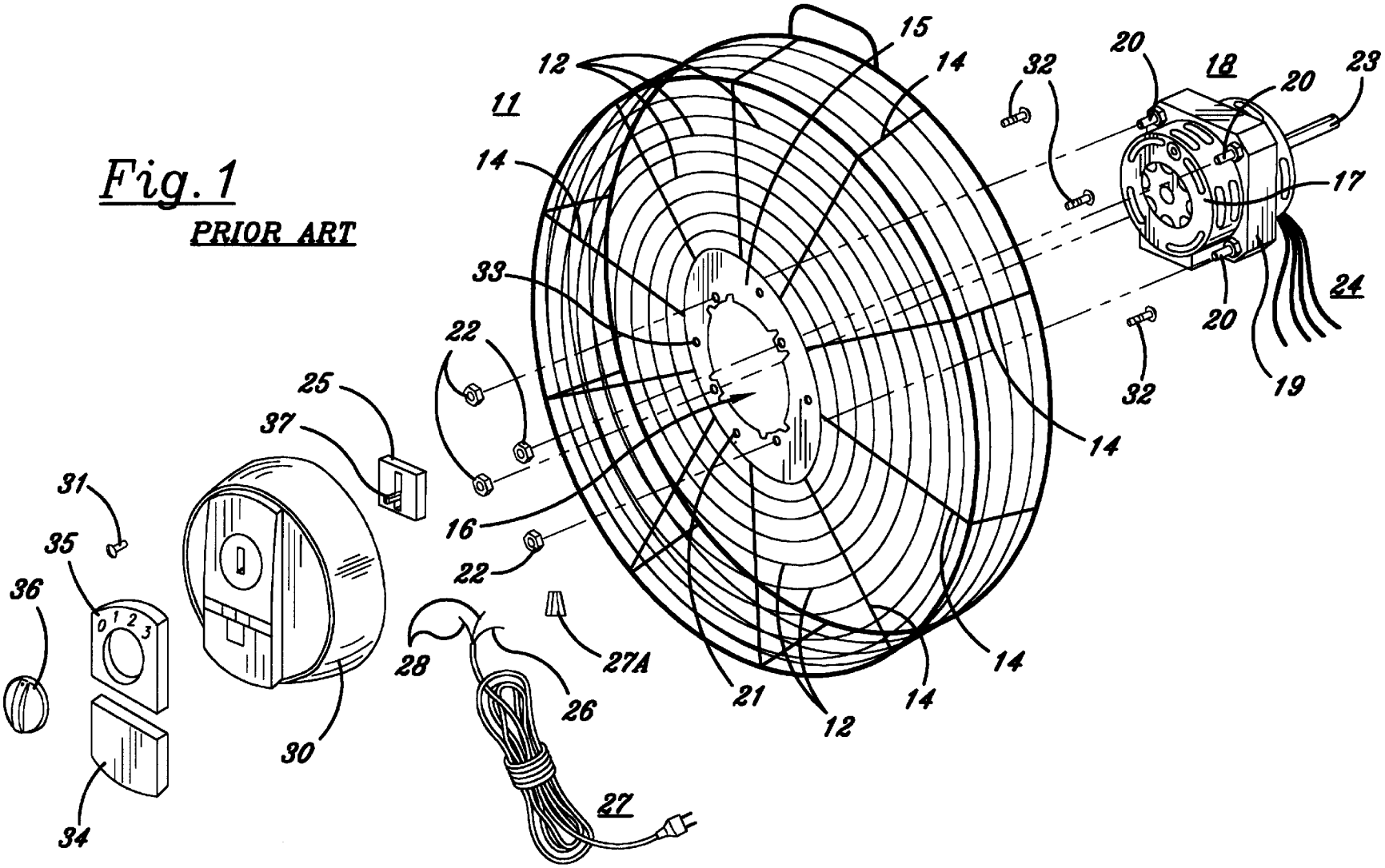
Fig. 1 PRIOR ART
FIG. 1 is an exploded perspective view of a prior art fan assembly.

Referring now more particularly to FIG. 1 of the drawings, a typical prior art high velocity fan 10 is therein illustrated.

The fan 10 includes a rear grill 11 of circular configuration with a plurality of circular wire ribs 12 of increasing diameter, which have a plurality of radially extending wire ribs 14 attached thereto, preferably by welding and securing them in spaced relationship. The radial ribs 14 are attached to a motor mounting plate 15, preferably by welding. The plate 15 is preferably of metal, with a central opening 16, which permits the rear portion 17 of a fan motor 18 to extend therethrough. The fan motor 18 is of conventional type, with a center plate 19 from which threaded mounting bolts 20 extend, four being shown, which are intended to be engaged in holes 21, in mounting plate 15, and retained thereto by nuts 22.

The fan motor 18 is provided with an output shaft 23 and motor leads 24, which leads are plugged into a multi-position switch 25, prior to attachment of motor 18 to plate 15, and one of them is attached to a ground lead 26, from a motor cord set 27, by a wire nut 27A. The cord set also has leads 28, which are also plugged into switch 25.

After assembly of the switch 25 and leads 24, 26 and 28, the cord set 27, switch 25, and leads are fed through grill 11 and the bolts 20 engaged in holes 21 in plate 15, the nuts 22 attached to bolts 20, and tightened drawing fan motor plate 19 into contact with the grill plate 15.

The switch 25 is positioned inside a motor cover 30, which is preferably of molded plastic, and of dish like configuration, the switch 25 being attached thereto by screw 31. The cover 30 is aligned with plate 15, and screws 32 are inserted through holes 33, in plate 15, and into bosses (not shown) in cover 30.

A name plate 34 is attached to cover 30 by adhesive (not shown) of well known type.

A switch plate 35 is provided attached to cover 30 by adhesive (not shown) of well known type, and a knob 36 is attached to stem 37 of switch 25.

The switch plate 35 is provided with indicia to indicate the knob 36 position's 15 of Off, 1, 2, or 3. A hub (not shown) of a fan blade assembly (not shown) is attached to motor output shaft 23.

A front grill (not shown) is provided, which is attached to rear grill 11 in well known manner.

Figure 2:
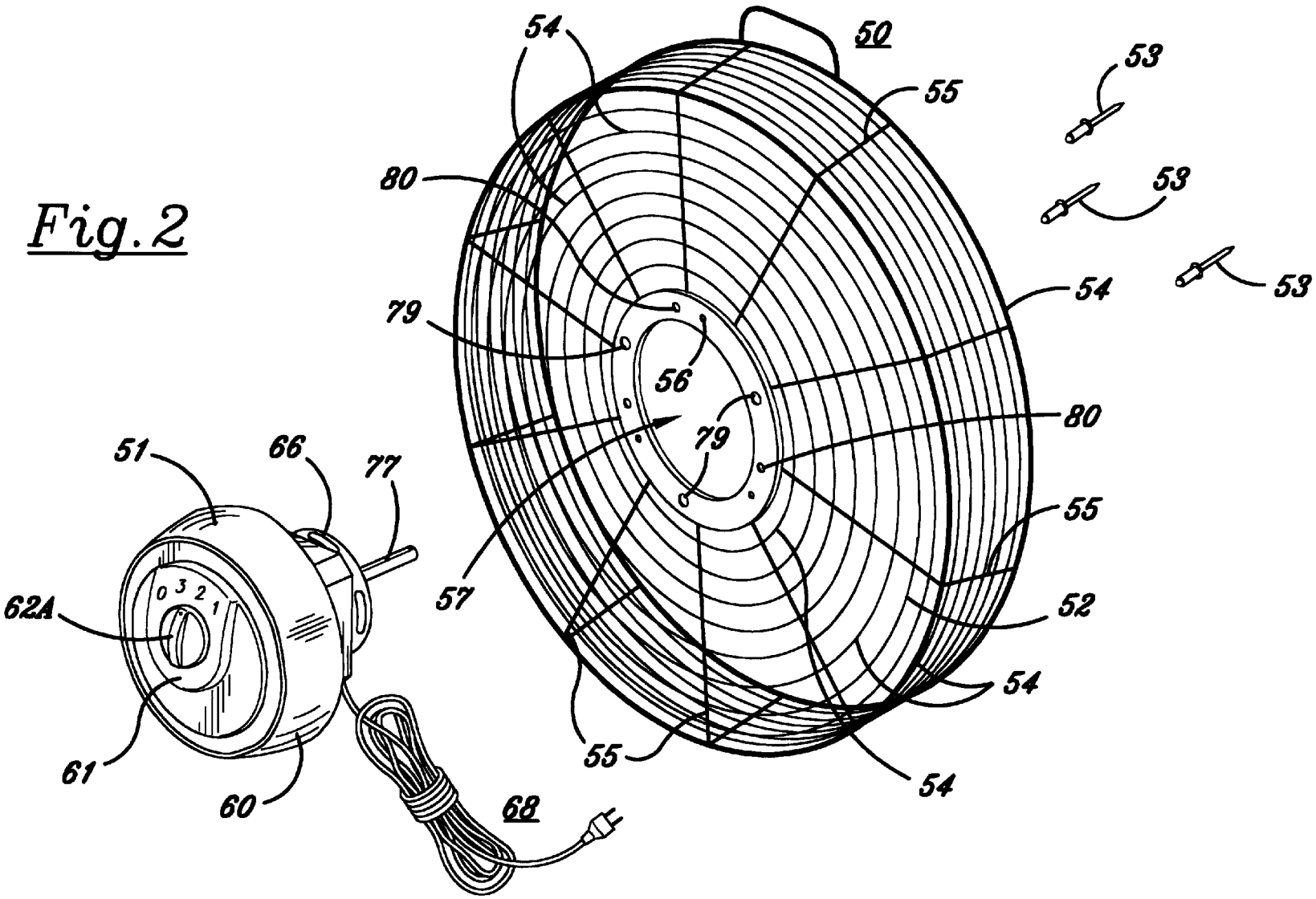
FIG. 2 is an exploded perspective view of the high velocity fan of the invention.
Figure 3:
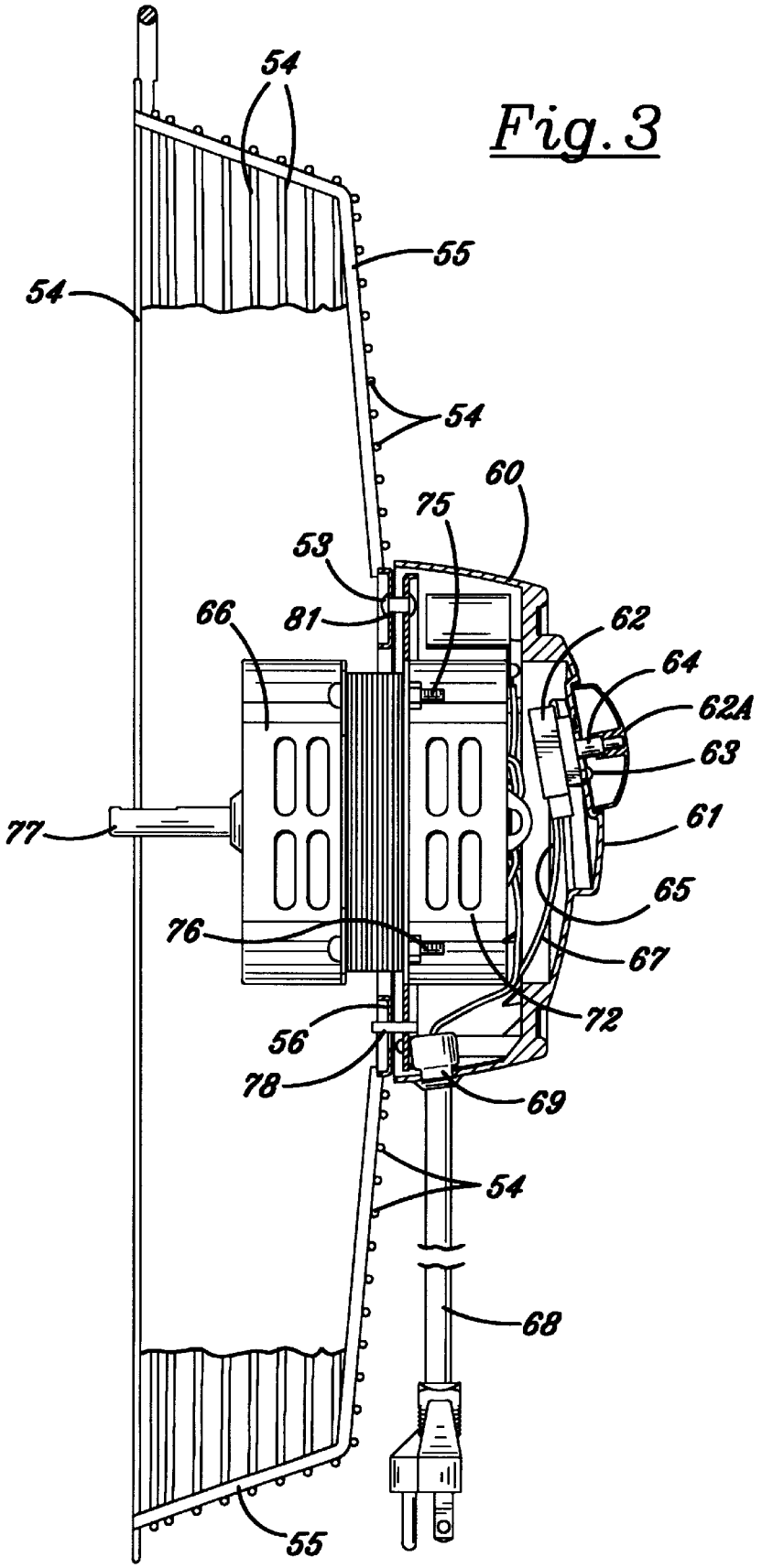
FIG. 3 is a vertical sectional view of the high velocity fan of the invention.

Referring now to FIGS. 2 and 3, the high velocity fan 50 of the invention is therein illustrated.

The fan 50 as illustrated in FIG. 2 includes a pre-assembled fan motor cover assembly 51, a rear grill 52, and a plurality of blind rivets 53, also known as pop rivets.

The rear grill 52 has a plurality of circular wire ribs 54 of increasing diameter, which are secured in spaced relationship by a plurality of radially extending radial wire ribs 55, which are preferably attached thereto by welding. The radial ribs 55 are attached to a metal grill plate 56, preferably by welding which plate 56 has a central opening 57.

The fan motor cover assembly 51 is shown in more detail in FIG. 2 and includes a cover 60 preferably of molded plastic, which is of dish-like configuration with a raised panel 61, which has the indicia Off 3, 2, and 1, thereon, to indicate the position of a multi-speed switch 62 to be described.

The switch 62 is of well known type and secured to panel 61 by screw 63, and has a stem 64 to which a knob 62A is attached in well known manner. The switch 62 has leads 65 attached thereto, which extend to a fan motor 66 of well known type, and leads 67 attached thereto, which are from cord set 68, which cord set extends through strain relief plug 69, in cover 60.

The cover 60 has a plurality of bosses (not shown) with which screws (not shown) are engaged and with a cover mounting plate 70.

The mounting plate 70 has an opening 71 through which the rear portion 72 of motor 66 extends, which motor 66 is attached to plate 70 by threaded bolts 75 and nuts 76. The motor 66 has a shaft 77 to which the hub of a fan blade assembly (not shown) is attached in well known manner.

The mounting plate 70 has a plurality of locator studs 78 extending therefrom, preferably three in number, which are engaged in holes 79 in grill plate 56 to locate the assembly 51.

The pop rivets 53 are engaged in holes 80, in the grill plate 56, and in holes 81 in cover mounting plate 70, retaining the fan motor cover assembly 51 to the rear grill 52.

To assemble the fan motor cover assembly 51 to rear grill 52, the assembly 51 is placed in a holding fixture (not shown) of well known type. The rear fan grill 52 is placed over the assembly 51, with the motor 66 extending through opening 71 in plate 70, and locator studs 78 in holes 79, in plate 56, and the pop rivets 52 engaged in holes 80, in plate 56, and holes 81 in plate 70 and the rivets 52 cinched in place. A fan blade assembly (not shown) and a front grill (not shown) are then attached in well known manner to complete the fan.

It will thus be seen that structure has been provided with which the objects of the invention are attained.

We claim:

1. In a high velocity fan which has open front and rear grills, the improvement which comprises a pre-assembled fan motor cover assembly for attachment to said rear grill, said fan motor cover assembly includes a motor, a cover, and a circular mounting plate to which said motor and said cover are attached, said mounting plate having a plurality of spaced openings around said plate, said rear grill having a circular grill plate, said grill plate has an opening through which a substantial portion of said motor extends, a plurality of spaced openings around said grill plate, and attachment means engaged with said openings in said mounting plate and said grill plate to fasten them together, whereby said fan motor is substantially inside said grill.

2. A fan as defined in claim 1 in which said attachment means are blind rivets.

3. A fan as defined in claim 1 in which said cover is of molded plastic.

4. A fan as defined in claim 1 in which said front and said rear has each have a plurality of circular wire ribs, a plurality of radial wire ribs fastened to said circular ribs, and said radial ribs are fastened to said rear grill plate.

5. A fan as defined in claim 1 in which said mounting plate has a plurality of locator studs extending therefrom, and said grill plate has a plurality of openings to receive said locator studs.

* * * * *